US006784136B2

(12) United States Patent
Iwasaki et al.

(10) Patent No.: US 6,784,136 B2
(45) Date of Patent: Aug. 31, 2004

(54) HEAT-SENSITIVE RECORDING MATERIAL

(75) Inventors: Nobuyuki Iwasaki, Nishinomiya (JP); Koichi Ishida, Amagasaki (JP)

(73) Assignee: Oji Paper Co., Ltd., Tokyo-to (JP)

( * ) Notice: Subject to any disclaimer, the term of this patent is extended or adjusted under 35 U.S.C. 154(b) by 46 days.

(21) Appl. No.: 09/988,466

(22) Filed: Nov. 20, 2001

(65) Prior Publication Data

US 2002/0094933 A1 Jul. 18, 2002

(30) Foreign Application Priority Data

Nov. 24, 2000 (JP) ..... 2000-357238
Nov. 27, 2000 (JP) ..... 2000-359084

(51) Int. Cl.[7] ..... B41M 5/30

(52) U.S. Cl. ..... 503/217; 503/200; 503/226; 503/209; 503/221

(58) Field of Search ..... 503/200, 209, 503/217, 221, 226

(56) References Cited

FOREIGN PATENT DOCUMENTS

| | | | |
|---|---|---|---|
| EP | 1 160 094 | A2 | 12/2001 |
| JP | 8-216528 | A | 8/1996 |
| JP | 9-11620 | A | 1/1997 |
| JP | 11-291633 | | 10/1999 |
| WO | 00/35679 | A1 | 6/2000 |
| WO | 01/72527 | A1 | 10/2001 |

*Primary Examiner*—B. Hamilton Hess
(74) *Attorney, Agent, or Firm*—Kubovcik & Kubovcik

(57) ABSTRACT

Disclosed is a heat-sensitive recording material comprising a support and a heat-sensitive recording layer formed on the support and containing a leuco dye and a developer, the developer being N-p-toluenesulfonyl-N'-3-(p-toluenesulfonyloxy)phenylurea, and the heat-sensitive recording layer containing (a) at least one fluoran-based leuco dye with a melting point of 190 to 230° C. and/or (b) at least one pigment selected from the group consisting of aluminum hydroxide, amorphous silica, kaolin and talc.

7 Claims, No Drawings

HEAT-SENSITIVE RECORDING MATERIAL

BACKGROUND OF THE INVENTION (1) Field of the Invention

The present invention relates to a heat-sensitive recording material that utilizes a color forming reaction between a leuco dye and a developer.

(2) Description of the Related Art

Heat-sensitive recording materials which utilize a color forming reaction between a leuco dye and a developer are relatively inexpensive and the required recording device is compact and easy to maintain, and therefore these materials are used in a wide range of fields, such as recording media for facsimile machines, word processors, various types of computers, and other such applications.

As the field of use of these heat-sensitive recording materials has expanded, the environments in which they are used have become increasingly severe. There is a need for a material that will simultaneously satisfy such requirements as good resistance of the non-recorded image portion to heat and light, good storage stability of the recorded image, and high-speed recording. So far, however, if the heat resistance and light resistance of the non-recorded image portion are improved, there has generally been a decrease in the storage stability of the recorded image and in recording sensitivity.

International Publication WO00/35679 discloses that a heat-sensitive recording material which makes use of N-p-toluenesulfonyl-N'-3-(p-toluenesulfonyloxy)phenylurea as a developer is superior in terms of recording sensitivity, resistance of the recorded image to oil, water, plasticizers and so forth, and resistance to background fogging, and other properties, but no specific measurement data is given.

Unexamined Japanese Patent Publication No. 1996-216528 discloses a heat-sensitive recording material which makes use of 3- (N-ethyl-p-toluidino)-6-methyl-7-anilinofluoran as a leuco dye, and 4,4'-dihydroxydiphenylsulfone or 2,4'-dihydroxydiphenylsulfone as a developer, and states that this recording material has excellent recording sensitivity and undergoes less degree of background fogging in a high temperature environment at 100° C., and has an excellent storage stability of the recorded image (with less decrease in recording density with a lapse of time).

Unexamined Japanese Patent Publication No. 1997-11620 discloses a heat-sensitive recording material which makes use of 3- (N-ethyl-p-toluidino)-6-methyl-7-anilinofluoran as a leuco dye and 4-hydroxy-4'-isopropoxydiphenylsulfone as a developer, and states that the recording material has excellent recording sensitivity, entails less decrease in the recording density of the recorded image in a high temperature environment of 80° C., undergoes less degree of background fogging, and has excellent resistance of the recorded image to humidity and water.

Further, Unexamined Japanese Patent Publication No. 1999-291633 discloses a heat-sensitive recording material that makes use of 3-(N-ethyl-p-toluidino)-6-methyl-7-anilinofluoran or 3-(N-ethyl-p-toluidino)-6-methyl-7-(p-toluidino)fluoran as a leuco dye and bis(3-allyl-4-hydroxyphenyl)sulfone as a developer, and states that the recording material is excellent in recording sensitivity, heat resistance (in a high temperature environment of 80° C.), humidity resistance, plasticizer resistance, water resistance and light resistance.

While these known heat-sensitive recording materials have the respective properties listed above, there is still a need for a heat-sensitive recording material with even better properties, and particularly a heat-sensitive recording material that is excellent in recording sensitivity, heat resistance in an environment of 90 to 100° C., light resistance, water resistance, plasticizer resistance, and so forth.

An object of the present invention is to provide a heat-sensitive recording material which has excellent properties such as recording sensitivity, heat resistance, light resistance, water resistance, plasticizer resistance and the like.

BRIEF SUMMARY OF THE INVENTION

In a heat-sensitive recording material comprising a support and as formed thereon a heat-sensitive recording layer containing a leuco dye and a developer, the present invention uses, as one means for achieving the above object, N-p-toluenesulfonyl-N'-3-(p-toluenesulfonyloxy)-phenylurea as the developer and the heat-sensitive recording layer contains at least one fluoran-based leuco dye having a melting point of 190 to 230° C. and/or at least one pigment selected from the group consisting of aluminum hydroxide, amorphous silica, kaolin and talc.

Specifically, the present invention provides the following heat-sensitive recording materials.

1. A heat-sensitive recording material comprising a support and a heat-sensitive recording layer formed on the support and containing a leuco dye and a developer, the developer being N-p-toluenesulfonyl-N'-3-(p-toluenesulfonyloxy)phenylurea, and the heat-sensitive recording layer containing (a) at least one fluoran-based leuco dye having a melting point of 190 to 230° C. and/or (b) at least one pigment selected from the group consisting of aluminum hydroxide, amorphous silica, kaolin and talc.

2. The heat-sensitive recording material according to Item 1, wherein the heat-sensitive recording layer contains N-p-toluenesulfonyl-N'-3-(p-toluene-sulfonyloxy)phenylurea as the developer and (a) at least one fluoran-based leuco dye with a melting point of 190 to 230° C. and (b) at least one pigment selected from the group consisting of aluminum hydroxide, amorphous silica, kaolin and talc.

3. The heat-sensitive recording material according to Item 2, wherein the fluoran-based leuco dye with a melting point of 190 to 230° C. is 3-(N-ethyl-p-toluidino)-6-methyl-7-anilinofluoran.

4. The heat-sensitive recording material according to Item 2, wherein the fluoran-based leuco dye with a melting point of 190 to 230° C. is 3-(N-ethyl-p-toluidino)-6-methyl-7-anilinofluoran and the pigment is aluminum hydroxide.

5. The heat-sensitive recording material according to Item 2, wherein the heat-sensitive recording layer further contains a sensitizer.

6. The heat-sensitive recording material according to Item 5, wherein the sensitizer is at least one member selected from the group consisting of 2-naphthyl benzyl ether, 1,2-di(3-methylphenoxy)ethane and 1,2-diphenoxyethane.

7. The heat-sensitive recording material according to Item 1, wherein the heat-sensitive recording layer contains N-p-toluenesulfonyl-N'-3-(p-toluene-sulfonyloxy)phenylurea as the developer and (b) at least one pigment selected from the group consisting of aluminum hydroxide, amorphous silica, kaolin and talc.

8. The heat-sensitive recording material according to Item 7, wherein the heat-sensitive recording layer contains a fluoran-based leuco dye with a melting point under 190° C.

9. The heat-sensitive recording material according to Item 7, wherein the pigment is aluminum hydroxide.

10. The heat-sensitive recording material according to Item 7, wherein the heat-sensitive recording layer further contains a sensitizer.

11. The heat-sensitive recording material according to Item 10, wherein the sensitizer is at least one member selected from the group consisting of 2-naphthyl benzyl ether, 1,2-di(3-methylphenoxy)ethane and 1,2-diphenoxyethane.

12. The heat-sensitive recording material according to Item 1, wherein the heat-sensitive recording layer contains N-p-toluenesulfonyl-N'-3-(p-toluene-sulfonyloxy) phenylurea as the developer and (a) at least one fluoran-based leuco dye with a melting point of 190 to 230° C.

13. The heat-sensitive recording material according to Item 12, wherein the fluoran-based leuco dye with a melting point of 190 to 230° C. is 3-(N-ethyl-p-toluidino)-6-methyl-7-anilinofluoran.

14. The heat-sensitive recording material according to Item 12, wherein the heat-sensitive recording layer further contains a sensitizer.

15. The heat-sensitive recording material according to Item 14, wherein the sensitizer is at least one member selected from the group consisting of 2-naphthyl benzyl ether, 1,2-di(3-methylphenoxy)ethane and 1,2-diphenoxyethane.

16. The heat-sensitive recording material according to Item 1, which further comprises, between the support and the heat-sensitive recording layer, an undercoat layer comprising as the main components a binder and at least one member selected from the group consisting of (i) an oil-absorbing pigment with an oil absorption (according to JIS K 5101) of at least 70 ml/100 g and (ii) organic hollow particles.

17. The heat-sensitive recording material according to Item 1, which further comprises, on the heat-sensitive recording layer, a protective layer comprising as the main components a binder which has a film-forming ability and, if desired, a pigment.

18. The heat-sensitive recording material according to Item 16, which further comprises, on the heat-sensitive recording layer, a protective layer comprising as the main components a binder which has a film-forming ability and, if desired, a pigment.

DETAILED DESCRIPTION OF THE INVENTION

As stated above, the present invention is characterized by the use of a specific developer, namely, N-p-toluenesulfonyl-N'-3-(p-toluenesulfonyloxy)phenylurea, and a specific leuco dye, namely, at least one fluoran-based leuco dye with a melting point of 190 to 230° C., and/or a specific pigment, namely, at least one member selected from the group consisting of aluminum hydroxide, amorphous silica (including one obtained from colloidal silica), kaolin and talc.

It is particularly favorable in the present invention that the above-mentioned specific developer is used in combination with the above-mentioned specific leuco dye and the above-mentioned specific pigment.

Developer

The specific developer, namely, N-p-toluenesulfonyl-N'-3-(p-toluenesulfonyloxy)-phenylurea, to be used in the present invention is a compound represented by the following formula (1).

(1)

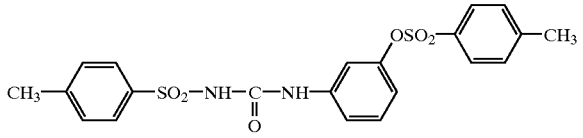

This compound is known and is commercially available.

While there is no particular restriction on the amount of the above-mentioned specific developer to be used, the specific developer is preferably used in an amount of about 10 to 60 wt %, more preferably about 20 to 40 wt %, based on the heat-sensitive recording layer.

Pigment

The pigment used in the present invention is at least one of the specific pigments selected from the group consisting of aluminum hydroxide, amorphous silica (including one obtained from colloidal silica), kaolin and talc.

There is no particular restriction on the amount of the specific pigment to be used, but the specific pigment is preferably used in an amount of about 3 to 50 wt %, more preferably about 5 to 25 wt %, based on the heat-sensitive recording layer. The use of this specific pigment results in excellent properties such as recording sensitivity, heat resistance, light resistance, water resistance and plasticizer resistance, and additionally produces the effect of improving resistance to background fogging caused by hot water (hereinafter referred to as "hot water background fogging resistance"). The heat-sensitive recording materials having excellent hot water background fogging resistance is advantageously used for lottery tickets, horse race tickets and the like, because the recorded images formed thereon are legible even if they are contacted with hot water, hot coffee, hot tea, etc.

Of the pigments listed above, the use of aluminum hydroxide is particularly favorable because the color density of the recorded image during heat-sensitive recording is higher.

The average particle diameter of the primary particles of the specific pigment can be selected from a wide range, but is preferably in the range of about 0.01 to 5 $\mu$m.

Leuco Dye

The specific leuco dye to be used in the present invention is a fluoran-based leuco dye with a melting point of 190 to 230° C.

When a fluoran-based leuco dye having a melting point of lower than 190° C. is used, severe background fogging may occasionally occur when the heat-sensitive recording material is exposed to a high temperature of 90 to 100° C. When a fluoran-based leuco dye having a melting point of higher than 230° C. is used, the recording sensitivity might be pronouncedly reduced. In general, it is particularly preferable that the specific leuco dye has a melting point of 200 to 220° C.

Examples of the specific leuco dye include fluoran-based leuco dyes which form black color, such as 3-pyrrolidino-6-methyl-7-anilinofluoran (melting point: 225° C.), 3-piperidino-6-methyl-7-anilinofluoran (melting point: 226° C.), 3-diethylamino-6-methyl-anilinofluoran (melting point: 192° C.), 3-(N-ethyl-p-toluidino)-6-methyl-7-anilinofluoran (melting point: 206° C.), 3-(N-ethyl-p-toluidino)-6-methyl-7-(p-toluidino) fluoran (melting point: 227° C.), 3-diethylamino-7-(o-chloroanilino)fluoran (melting point: 218° C.), 3-(N-cyclohexyl-N-methylamino)-6-methyl-7-anilinofluoran (melting point: 202° C.), fluoran-based leuco dyes which form red color, such as 3-diethylamino-benzo [α] fluoran (melting point: 219° C.), 3-diethylamino-7,8-benzofluoran (melting point: 217° C.), and the like. Two or more of these specific leuco dyes can also be used in admixture.

Among these, fluoran-based leuco dyes which form black color, and especially 3-(N-ethyl-p-toluidino)-6-methyl-7-anilinofluoran (melting point: 206° C.) is preferable because the resulting heat-sensitive recording material is excellent in background fogging resistance, dynamic recording sensitivity and light resistance of the recorded image.

The above-mentioned specific leuco dye is preferably used in an amount of about 5 to 35 wt %, more preferably about 10 to 25 wt %, based on the heat-sensitive recording layer.

Sensitizer

If desired, the heat-sensitive recording layer may contain one or more various known sensitizers in order to further enhance the recording sensitivity. Specific examples of such sensitizers include parabenzylbiphenyl, dibenzyl terephthalate, phenyl 1-hydroxy-2-naphthoate, dibenzyl oxalate, di(o-chlorobenzyl)adipate, 2-naphthyl benzyl ether, 1,2-diphenoxyethane, 1,2-di(3-methylphenoxy)ethane, 1,2-di(3,4-dimethylphenyl)ethane, 1,3-bis(2-naphthoxy) propane, di(p-methylbenzyl) oxalate, di(p-chlorobenzyl) oxalate, meta-terphenyl, diphenyl, benzophenone, 2-(2'-hydroxy-5'-methylphenyl)benzotriazole and the like.

Among these, 2-naphthyl benzyl ether, 1,2-di(3-methylphenoxy)ethane and 1,2-diphenoxyethane are particularly favorable because they are effective for achieving excellent dynamic recording sensitivity and outstanding heat resistance of the unrecorded portion.

The amount of the sensitizer to be used in the heat-sensitive recording layer is about 1 to 10 weight parts, preferably about 1 to 5 weight parts, per weight part of the specific leuco dye.

Optional Components

At least the specific developer, (a) the specific leuco dye and/or (b) the specific pigment are used in the heat-sensitive recording layer of the present invention, and if desired, other leuco dyes, other developers, and other pigments can also be used, and other components can also be added, insofar as they do not impair the desired effects of the present invention.

If such optional components are used, for example, in a heat-sensitive recording layer containing the specific developer, the specific leuco dye and the specific pigment, said other developer can be used in an amount of not more than 10 wt %, particularly about 1 to 10 wt %, based on the specific developer; said other leuco dye can be used in an amount of not more than 10 wt %, particularly about 1 to 10 wt %, based on the specific leuco dye, and said other pigment can be used in an amount of not more than 10 wt %, particularly about 1 to 10 wt %, based on the specific pigment. It is also preferable that the total amount of the specific pigment and said other pigment is about 5–55 wt %, more preferably about 6–30 wt %, based on the heat-sensitive recording layer.

Examples of said other leuco dyes include 3-diethylamino-7-(m-trifluoromethylanilino)fluoran, 3-(N-isoamyl-N-ethylamino)-7-(o-chloroanilino)fluoran, 3-diethylamino-6-chloro-7-anilinofluoran, 3-di(n-butyl) amino-6-methyl-7-anilinofluoran, 3-di(n-pentyl)amino-6-methyl-7-anilinofluoran, 3,3-bis(p-dimethylaminophenyl)-6-dimethylaminophthalide, and 3-(4-diethylamino-2-methylphenyl)-3-(4-dimethylaminophenyl)-6-dimethylaminophthalide.

Examples of said other developers include 4,4'-isopropylidendiphenol, 4,4'-dihydroxydiphenyl ether, 3,3'-diallyl-4,4'-dihydroxydiphenylsulfone, 4,4'-cyclohexylidenediphenol, 1,1-bis(4-hydroxyphenyl)ethane, 1,1-bis(4-hydroxyphenyl)-1-phenylethane, 4,4'-dihydroxydiphenyl sulfide, 4,4'-thiobis(3-methyl-6-tert-butylphenol), 4,4'-dihydroxydiphenylsulfone, 2,4'-dihydroxydiphenylsulfone, 4-hydroxy-4'-isopropoxydiphenylsulfone, benzyl 4-hydroxybenzoate, zinc 3-(α-methylbenzyl)salicylate, zinc 3,5-di-tert-butylsalicylate, and zinc 4-[3-(p-tolylsulfonylphenoxyethoxy)cumyl]salicylate.

Examples of said other pigments include precipitated calcium carbonate, ground calcium carbonate, calcined kaolin, titanium oxide, magnesium carbonate, barium sulfate, urea-formalin resin filler and the like.

A print stability-improving agent can also be contained in the heat-sensitive recording layer in order to further enhance the storage stability of the recorded image. Examples of such print stability-improving agent include 1,1,3-tris(2-methyl-4-hydroxy-5-cyclohexylphenyl)butane, 1,1,3-tris(2-methyl-4-hydroxy-5-tert-butylphenyl)butane, 1,1-bis(2-methyl-4-hydroxy-5-tert-butylphenyl)butane, 4,4'-[1,4-phenylenebis(1-methylethylidene)]-bisphenol, 4,4'-[1,3-phenylenebis(1-methylethylidene)]-bisphenol, 4-benzyloxyphenyl-4'-(2-methyl-2,3-epoxypropyloxy)phenylsulfone, 4-(2-methyl-1,2-epoxyethyl)diphenylsulfone, 1,3,5-tris(2,6-dimethylbenzyl-3-hydroxy-4-tert-butyl)isocyanuric acid and the like. Such print stability-improving agent, if employed, is used in an amount of about 0.1 to 30 wt %, preferably about 1 to 20 wt %, based on the heat-sensitive recording layer.

Heat-sensitive Recording Layer

The heat-sensitive recording layer is obtained, for example, as follows. The specific developer, the specific leuco dye and, if desired, a sensitizer and the above-mentioned optional components (such as a print-stability improving agent) are pulverized usually in water serving as a dispersion medium, either jointly or separately, by means of a ball mill, an attritor, a sand mill or like pulverizer to an average particle diameter of about 0.2 to 2.0 μm. Then to the mixture are added a binder, the specific pigment and, if desired, the following one or more auxiliaries, and the resulting mixture is stirred to prepare a heat-sensitive recording layer coating composition. The coating composition is applied to a support and the resulting coating is dried.

The support can be a variety of suitable supports used in this field, and examples thereof include wood-free paper made from non-chlorine bleached pulp, plastic films, base paper containing waste paper, and synthetic paper.

Examples of binders include polyvinyl alcohol, carboxy-modified polyvinyl alcohol, acetoacetyl-modified polyvinyl alcohol, diacetone-modified polyvinyl alcohol, silicon-modified polyvinyl alcohol, oxidized starch, gelatin, casein, starch-vinyl acetate graft copolymers, styrene-maleic anhydride copolymers, methyl vinyl ether-maleic anhydride copolymers, isopropylene-maleic anhydride copolymers and like water-soluble resins, styrene-butadiene latex, acrylic latex, urethane latex and like water-dispersible resins, etc. The amount of the binder to be used is about 5 to 40 wt %, preferably about 10 to 30 wt %, based on the heat-sensitive recording layer.

Various auxiliaries can be added to the heat-sensitive recording layer coating composition, if so desired. Examples of such auxiliaries include sodium dioctylsulfosuccinate, sodium dodecylbenzenesulfonate, sodium lauryl sulfate, fatty acid metal salts and like surfactants, zinc stearate, calcium stearate, polyethylene wax, carnauba wax, paraffin wax, ester wax and like waxes, glyoxal, urea formalin resin, polyamide resin, polyamideamine-epichlorohydrin resin, adipic acid dihydrazide, boric acid, borax, zirconium ammonium carbonate and like insolubilizers, UV absorbents, anti-foaming agents, fluorescent dyes, coloring dyes, and so forth.

The coating amount of the heat-sensitive recording layer coating composition is about 2 to 12 g/m$^2$, preferably about 3 to 7 g/m$^2$, on a dry weight basis. The heat-sensitive recording layer coating composition is applied to the support by a known coating device such as a bar coater, an air knife coater, a blade coater, a gravure coater, a die coater and the like. After the coating layer is dried, the resulting heat-sensitive recording layer can be treated with a super calender, gloss calender or the like to impart smoothness to the surface.

Preferred Embodiments

In a preferred embodiment of the present invention, the heat-sensitive recording layer of the heat-sensitive recording material of the present invention contains the above-mentioned specific developer, (a) the above-mentioned specific leuco dye, (b) the specific pigment, and if desired, the above-mentioned sensitizer. In particular, the heat-sensitive recording layer of the heat-sensitive recording material of the present invention preferably contains N-p-toluenesulfonyl-N'-3-(p-toluenesulfonyloxy)phenylurea, (a) 3-(N-ethyl-p-toluidino)-6-methyl-7-anilinofluoran, (b) aluminum hydroxide and, if desired, the above-mentioned sensitizer. The heat-sensitive recording material according to this embodiment is advantageous because it is excellent in dynamic recording sensitivity, heat resistance, light resistance, water resistance, hot water background fogging resistance and plasticizer resistance.

Protective Layer

If necessary, a protective layer may be provided on the heat-sensitive recording layer in order to enhance the resistance of the recorded image to chemicals and water, or to improve runability during recording. This protective layer is formed by coating the heat-sensitive recording layer with a protective layer coating composition comprising as main components a binder having film-forming ability and, if needed, a pigment, and then drying the resulting coating film.

Examples of the binder to be contained in the protective layer coating composition include completely saponified polyvinyl alcohol, partially saponified polyvinyl alcohol, carboxy-modified polyvinyl alcohol, acetoacetyl-modified polyvinyl alcohol, silicon-modified polyvinyl alcohol, diacetone-modified polyvinyl alcohol, and other such polyvinyl alcohols, starches, hydroxyethyl cellulose, methyl cellulose, carboxymethyl cellulose, gelatin, casein, gum arabic, diisobutylene-maleic anhydride copolymer salts, styrene-maleic anhydride copolymer salts, ethylene-acrylic acid copolymer salts, styrene-acrylic acid copolymer salts, styrene-butadiene-based latex, acrylic-based latex, and urethane-based latex.

The foregoing auxiliaries that can be added to the above-mentioned heat-sensitive recording layer coating composition can also be added to the protective layer coating composition.

Undercoat Layer

If desired, an undercoat layer can also be provided between the support and the heat-sensitive recording layer in order to improve recording sensitivity and runability during recording. The undercoat layer is formed by coating the support with an undercoat layer coating composition comprising as main components organic hollow particles and/or an oil-absorbing pigment with an oil absorption (based on JIS K 5101) of at least 70 ml/100 g, and particularly about 80 to 150 ml/100 g, and a binder, and then drying the coating.

Various oil-absorbing pigments can be used for the above purpose. Typical examples thereof include inorganic pigments such as calcined clay, amorphous silica, precipitated calcium carbonate, talc and the like. Preferably, the average particle diameter of the primary particles of this pigment is about 0.01 to 5 $\mu$m, particularly about 0.02 to 3 $\mu$m. The amount of the oil-absorbing pigment to be used can be selected from a wide range, but it is usually preferable to use the oil-absorbing pigment in an amount of 50 to 95 wt. %, particularly about 70 to 90 wt. %, based on the undercoat layer.

As the organic hollow particles, various known organic hollow particles can be used, and typical examples thereof include particles having a shell made of an acrylic resin, styrene-based resin, vinylidene chloride-based resin or the like and having a void ratio of about 50 to 99%. Herein, the term "void ratio" is defined as $(d/D)\times 100$, wherein d is the inside diameter of the organic hollow particles and D is the outside diameter of the organic hollow particles. It is preferable that the organic hollow particle has an average outside diameter of about 0.5 to 10 $\mu$m, particularly about 1 to 5 $\mu$m. The amount of the above-mentioned organic hollow particles to be used can be selected from a wide range. Generally, the amount is preferably about 20 to 90 wt. %, particularly about 30 to 70 wt. %, based on the undercoat layer.

The above-mentioned organic hollow particles may be expandable hollow particles. Typical examples of such expandable hollow particles are microcapsules having an average particle diameter of 0.1 to 5 $\mu$m, each of which comprises a shell made of, for example, vinylidene chloride resin and butane gas as enclosed in the shell. When the undercoat layer coating composition containing such expandable hollow particles is applied to a support and dried to form an undercoat layer, and the undercoat layer is then brought into close contact with a plate heated at about 80–150° C., this heat-treatment causes the butane gas enclosed in the microcapsules to expand with the result that the microcapsules expand to an average particle diameter of 1–30 $\mu$m.

When the above-mentioned oil-absorbing inorganic pigment is used in combination with the organic hollow particles, the oil-absorbing pigment and the organic hollow particles are used in an amount within the range specified above, and the combined amount of the oil-absorbing inorganic pigment and the organic hollow particles is preferably about 40 to 90 wt. %, particularly about 50 to 80 wt. %, based on the undercoat layer.

It is preferable that the above-mentioned binder is selected from the binders to be used in the heat-sensitive recording layer, and particularly a starch-vinyl acetate copolymer, a polyvinyl alcohol, a styrene-butadiene latex, or the like.

The amount of the binder to be used can be selected from a wide range, but it is generally preferable that the amount of the binder is about 5 to 30 wt. %, particularly about 10 to 20 wt. %, based on the undercoat layer.

The coating amount of the undercoat layer coating composition is 3 to 20 g/m$^2$, preferably about 5 to 12 g/m$^2$, on dry weight basis, while the coating amount of the protective layer coating composition is 0.5 to 10 g/m$^2$, preferably about 1 to 5 g/m$^2$, on dry weight basis.

The protective layer coating composition and undercoat layer coating composition are applied with a known coating device such as a bar coater, an air knife coater, a blade coater, a gravure coater, a die coater or the like. After the coating is dried, each layer can be treated with a super calender, a gloss calender or the like to impart smoothness to the surface.

It is also possible to provide a protective layer, an adhesive layer, a magnetic recording layer or the like on the rear side of the support. Also, various technologies known in the field of manufacturing heat-sensitive recording materials can be added, if so desired.

EXAMPLES

The present invention will be described in further detail with reference to examples, but the present invention is not limited to these examples. Unless otherwise specified, all "parts" and "%" indicate "weight parts" and "wt %," respectively. The average particle diameters are measured using an electron microscope.

Example 1

Preparation of Undercoat Layer Coating Composition

A composition composed of 60 parts of calcined clay (trade name: Ansilex, oil absorption 110 ml/100 g, made by Engelhard Corporation), 100 parts of a 20% dispersion of organic expandable hollow particles (inside diameter/outside diameter=0.95; shell material=polyvinylidene chloride) which expand to an average particle diameter of about 5 μm upon expansion, 1 part of a 40% aqueous solution of a polyacrylic acid sodium salt, 14 parts of a styrene-butadiene latex with a solids concentration of 48%, 50 parts of a 10% aqueous solution of polyvinyl alcohol (degree of saponification: 88%, degree of polymerization: 1000) and 40 parts of water was mixed and stirred to obtain an undercoat layer coating composition.

Preparation of Dispersion A

A composition composed of 10 parts of N-p-toluenesulfonyl-N'-3-(p-toluenesulfonyloxy)phenylurea, 5 parts of a 5% aqueous solution of methyl cellulose and 25 parts of water was pulverized in a sand mill to an average particle diameter of 1.0 μm to obtain Dispersion A.

Preparation of Dispersion B

A composition composed of 10 parts of a fluoran-based leuco dye which forms black color, i.e., 3-(N-ethyl-p-toluidino)-6-methyl-7-anilinofluoran (melting point: 206° C.), 5 parts of a 5% aqueous solution of methyl cellulose and 25 parts of water was pulverized in a sand mill to an average particle diameter of 1.0 μm to obtain Dispersion B.

Preparation of Dispersion C

A composition composed of 10 parts of 1,2-di(3-methylphenoxy)ethane, 5 parts of a 5% aqueous solution of methyl cellulose and 25 parts of water was pulverized in a sand mill to an average particle diameter of 1.0 μm to obtain Dispersion C.

Preparation of Dispersion D

A composition composed of 40 parts of aluminum hydroxide (trade name: Higilite H42, made by Showa Denko, average particle diameter of primary particles: 1 μm), 1 part of a 40% aqueous solution of a polyacrylic acid sodium salt and 40 parts of water was mixed and stirred to obtain Dispersion D.

Preparation of Heat-sensitive Recording Layer Coating Composition 120 parts of Dispersion A, 40 parts of Dispersion B, 80 parts of Dispersion C, 40 parts of Dispersion D, 160 parts of a 10% aqueous solution of polyvinyl alcohol (degree of polymerization: 100, degree of saponification: 98%), 20 parts of a styrene-butadiene latex with a solids concentration of 50% and 12.5 parts of a 40% aqueous solution of glyoxal were mixed and stirred to obtain a heat-sensitive recording layer coating composition.

Preparation of Protective Layer Coating Composition 500 parts of a 10% aqueous solution of acetoacetyl-modified polyvinyl alcohol (trade name: Gohsefimer Z200, made by The Nippon Synthetic Chemical Industry Co., Ltd.), 40 parts of a 50% aqueous dispersion of kaolin (trade name UW-90, made by Engelhard Corporation) and 40 parts of a 50% aqueous dispersion of aluminum hydroxide (trade name: Higilite H42, made by Showa Denko) were mixed and stirred to obtain a protective layer coating composition.

Production of Heat-sensitive Recording Material

One side of wood free paper (neutral paper) weighing 64 g/m$^2$ was coated with the above undercoat layer coating composition such that the coating amount was 7 g/m$^2$ on dry weight basis, and the coating was dried. This coated side was then brought into close contact with a chromium-plated, mirror-finish metal hot roll (120° C.). This heat-treatment caused the organic expandable particles to expand, whereby an undercoat layer was formed.

The undercoat layer thus formed was coated with the heat-sensitive recording layer coating composition such that the coating amount after drying was 6 g/m$^2$, and the coating was dried to form a heat-sensitive recording layer.

The resulting heat-sensitive recording layer was then coated with the protective layer coating composition such that the coating amount after drying was 3 g/m$^2$ to obtain a heat-sensitive recording material. The heat-sensitive recording material thus obtained was subjected to a surface smoothing treatment with a super calender.

Example 2

A heat-sensitive recording material was obtained in the same manner as in Example 1 except that amorphous silica (trade name Mizukasil P-603, made by MIZUSAWA INDUSTRIAL CHEMICALS, LTD.) was used in place of aluminum hydroxide in the preparation of Dispersion D in Example 1.

Example 3

A heat-sensitive recording material was obtained in the same manner as in Example 1 except that kaolin (trade name UW-90, made by Engelhard Corporation, average particle diameter of primary particles: 1 μm) was used in place of aluminum hydroxide in the preparation of Dispersion D in Example 1.

Example 4

A heat-sensitive recording material was obtained in the same manner as in Example 1 except that talc (trade name Hymicron, made by Takehara Kagaku Kabushiki Kaisha, average particle diameter of primary particles: 5 μm) was used in place of aluminum hydroxide in the preparation of Dispersion D in Example 1.

Example 5

A heat-sensitive recording material was obtained in the same manner as in Example 1 except that 10 parts of 1,2-diphenoxyethane was used instead of 10 parts of 1,2-di(3-methylphenoxy)ethane in the preparation of Dispersion C in Example 1.

Example 6

A heat-sensitive recording material was obtained in the same manner as in Example 1 except that 10 parts of 3-di(n-butyl)amino-6-methyl-7-anilinofluoran (melting point: 182° C.) was used instead of 10 parts of 3-(N-ethyl-p-toluidino)-6-methyl-7-anilinofluoran in the preparation of Dispersion B in Example 1.

Comparative Example 1

Preparation of Undercoat Layer Coating Composition

A composition composed of 40 parts of calcined clay (trade name: Ansilex, oil absorption 110 ml/100 g, made by Engelhard Corporation), 100 parts of a 40% dispersion of organic hollow particles having an average particle diameter of 1.0 μm (inside diameter/outside diameter: 0.7, shell material: polystyrene), 1 part of a 40% aqueous solution of sodium salt of polyacrylic acid, 14 parts of a styrene-butadiene latex with a solids concentration of 48%, 50 parts of a 10% aqueous solution of polyvinyl alcohol (degree of saponification: 88%, degree of polymerization: 1000), and 40 parts of water was mixed and stirred to obtain an undercoat layer coating composition.

Preparation of Dispersion A

A composition composed of 10 parts of N-p-toluenesulfonyl-N'-3-(p-toluenesulfonyloxy)phenylurea, 5 parts of a 5% aqueous solution of methyl cellulose and 25 parts of water was pulverized in a sand mill to an average particle diameter of 1.0 μm to obtain Dispersion A.

Preparation of Dispersion B

A composition composed of 10 parts of a fluoran-based leuco dye which forms black color, i.e., 3-(N-ethyl-p-toluidino)-6-methyl-7-anilinofluoran (melting point: 206° C.), 5 parts of a 5% aqueous solution of methyl cellulose and 25 parts of water was pulverized in a sand mill to an average particle diameter of 1.0 μm to obtain Dispersion B.

Preparation of Dispersion C

A composition composed of 10 parts of 1,2-di(3-methylphenoxy)ethane, 5 parts of a 5% aqueous solution of methyl cellulose and 25 parts of water was pulverized in a sand mill to an average particle diameter of 1.0 μm to obtain Dispersion C.

Preparation of Heat-sensitive Recording Layer Coating Composition 120 parts of Dispersion A, 40 parts of Dispersion B, 80 parts of Dispersion C, 160 parts of a 10% aqueous solution of polyvinyl alcohol (degree of polymerization: 100, degree of saponification: 98%), 20 parts of a styrene-butadiene latex with a solids concentration of 50%, 17 parts of precipitated calcium carbonate and 12.5 parts of a 40% aqueous solution of glyoxal were mixed and stirred to obtain a heat-sensitive recording layer coating composition.

Preparation of Protective Layer Coating Composition 500 parts of a 10% aqueous solution of acetoacetyl-modified polyvinyl alcohol (trade name: Gohsefimer Z200, made by The Nippon Synthetic Chemical Industry Co., Ltd.), 40 parts of a 50% aqueous dispersion of kaolin (trade name UW-90, made by Engelhard Corporation) and 40 parts of a 50% aqueous dispersion of aluminum hydroxide (trade name: Higilite H42, made by Showa Denko) were mixed and stirred to obtain a protective layer coating composition.

Production of Heat-sensitive Recording Material

One side of wood free paper (neutral paper) weighing 64 g/m$^2$ was coated with the above undercoat layer coating composition such that the coating amount was 9 g/m$^2$ on dry weight basis, and the coating was dried, whereby an undercoat layer was formed.

The undercoat layer thus formed was coated with the heat-sensitive recording layer coating composition such that the coating amount after drying was 6 g/m$^2$, and the coating was dried to form a heat-sensitive recording layer.

The resulting heat-sensitive recording layer was then coated with the protective layer coating composition such that the coating amount after drying was 3 g/m$^2$ to obtain a heat-sensitive recording material. The heat-sensitive recording material thus obtained was subjected to a surface smoothing treatment with a super calender.

Comparative Example 2

A heat-sensitive recording material was obtained in the same manner as in Comparative Example 1 except that a fluoran-based leuco dye capable of forming black color, namely 3-(N-ethyl-p-toluidino)-6-methyl-7-(p-toluidino) fluoran (melting point: 227° C.) was used instead of 3-(N-ethyl-p-toluidino)-6-methyl-7-anilinofluoran (melting point: 206° C.) in the preparation of Dispersion B in Comparative Example 1.

Comparative Example 3

A heat-sensitive recording material was obtained in the same manner as in Comparative Example 1 except that a fluoran-based leuco dye capable of forming black color, namely 3-pyrrolidino-6-methyl-7-anilinofluoran (melting point: 225° C.) was used instead of 3-(N-ethyl-p-toluidino)-6-methyl-7-anilinofluoran (melting point: 206° C.) in the preparation of Dispersion B in Comparative Example 1.

Comparative Example 4

A heat-sensitive recording material was obtained in the same manner as in Comparative Example 1 except that a fluoran-based leuco dye capable of forming black color, namely 3-diethylamino-6-methyl-7-anilinofluoran (melting point: 192° C.) was used instead of 3-(N-ethyl-p-toluidino)-6-methyl-7-anilinofluoran (melting point: 206° C.) in the preparation of Dispersion B in Comparative Example 1.

Comparative Example 5

A heat-sensitive recording material was obtained in the same manner as in Comparative Example 1 except that a fluoran-based leuco dye capable of forming red color, namely 3-diethylamino-7,8-benzofluoran (melting point: 217° C.), was used instead of 3-(N-ethyl-p-toluidino)-6-methyl-7-anilinofluoran (melting point: 206° C.) in the preparation of Dispersion B in Example 1.

Comparative Example 6

A heat-sensitive recording material was obtained in the same manner as in Comparative Example 1 except that 10 parts of 2-naphthyl benzyl ether was used instead of 10 parts of 1,2-di(3-methylphenoxy)ethane in the preparation of Dispersion C in Comparative Example 1.

Comparative Example 7

A heat-sensitive recording material was obtained in the same manner as in Comparative Example 1 except that 10 parts of di(p-methylbenzyl) oxalate was used instead of 10 parts of 1,2-di(3-methylphenoxy)ethane in the preparation of Dispersion C in Example 1.

Comparative Example 8

A heat-sensitive recording material was obtained in the same manner as in Example 1 except that 10 parts of 2-(2'-hydroxy-5'-methylphenyl)benzotriazole was used instead of 10 parts of 1,2-di(3-methylphenoxy)ethane in the preparation of Dispersion C in Example 1.

Comparative Example 9

A heat-sensitive recording material was obtained in the same manner as in Example 1 except that magnesium carbonate (trade name: Precipitated Magnesium Carbonate, made by Kyowa Chemical Industry Co., Ltd.) was used instead of aluminum hydroxide in the preparation of Dispersion D in Example 1.

Comparative Example 10

A heat-sensitive recording material was obtained in the same manner as in Example 1 except that Dispersion D was not used in the preparation of the heat-sensitive recording layer coating composition in Example 1.

Comparative Example 11

A heat-sensitive recording material was obtained in the same manner as in Example 1 except that 10 parts of 4-hydroxy-4'-isopropoxydiphenylsulfone was used instead of 10 parts of N-p-toluenesulfonyl-N'-3-(p-toluenesulfonyloxy)phenylurea in the preparation of Dispersion A in Example 1.

Comparative Example 12

A heat-sensitive recording material was obtained in the same manner as in Comparative Example 1 except that 10 parts of bis(3-allyl-4-hydroxyphenyl)sulfone was used instead of 10 parts of N-p-toluenesulfonyl-N'-3-(p-toluenesulfonyloxy)-phenylurea in the preparation of Dispersion A in Comparative Example 1.

Comparative Example 13

A heat-sensitive recording material was obtained in the same manner as in Comparative Example 1 except that 10 parts of 2,4'-dihydroxydiphenylsulfone was used instead of 10 parts of N-p-toluenesulfonyl-N'-3-(p-toluenesulfonyloxy)phenylurea in the preparation of Dispersion A in Comparative Example 1.

Comparative Example 14

A heat-sensitive recording material was obtained in the same manner as in Comparative Example 1 except that 10 parts of a fluoran-based leuco dye capable of forming black color, i.e., 3-di (n-butyl) amino-6-methyl-7-anilinofluoran (melting point: 182° C.) was used instead of 10 parts of 3-(N-ethyl-p-toluidino)-6-methyl-7-anilinofluoran (melting point: 206° C.) in the preparation of Dispersion B in Comparative Example 1.

Comparative Example 15

A heat-sensitive recording material was obtained in the same manner as in Comparative Example 1 except that 10 parts of a fluoran-based leuco dye capable of forming black color, i.e., 3-(N-ethyl-N-isoamylamino)-6-methyl-7-anilinofluoran (melting point: 164° C.) was used instead of 10 parts of 3-(N-ethyl-p-toluidino)-6-methyl-7-anilinofluoran (melting point: 206° C.) in the preparation of Dispersion B in Comparative Example 1.

Comparative Example 16

A heat-sensitive recording material was obtained in the same manner as in Comparative Example 1 except that 10 parts of a phthalide compound capable of forming blue color, namely 3-(4-diethylamino-2-methylphenyl)-3-(4-dimethylaminophenyl)-6-dimethylaminophthalide (melting point: 217° C.), was used as a leuco dye instead of 10 parts of 3-(N-ethyl-p-toluidino)-6-methyl-7-anilinofluoran (melting point: 206° C.) in the preparation of Dispersion B in Comparative Example 1.

Comparative Example 17

A heat-sensitive recording material was obtained in the same manner as in Comparative Example 1 except that a fluoran-based leuco dye capable of forming red color, namely 3-diethylamino-6-methyl-7-chlorofluoran (melting point: 235° C.) was used instead of 3-(N-ethyl-p-toluidino)-6-methyl-7-anilinofluoran (melting point: 206° C.) in the preparation of Dispersion B in Example 1.

The heat-sensitive recording materials obtained above were subjected to the following evaluation tests, and the results are shown in Table 1.

Recording Density

Using a thermosensitive printing tester (product name: TH-PMD, manufactured by Okura Denki Kabushiki Kaisha), each heat-sensitive recording material was colored at an applied energy of 0.50 mJ/dot, and the color density of the recorded image thus obtained was measured in visual mode with a Macbeth densitometer (trade name: model RD-914, made by Macbeth).

Heat Resistance

After recording in the measurement of recording density, the heat-sensitive recording material was left to stand for 5 hours in a dryer maintained at 90° C., and then the optical density of the unrecorded portion was measured with a Macbeth densitometer to evaluate the heat resistance.

Light Resistance

After recording in the measurement of recording density, the heat-sensitive recording material was left to stand for 24 hours in a xenon weatherometer (68 W/m$^2$—300 to 400 nm) maintained at 63° C. and 40% RH, and then the optical density of the unrecorded portion and the optical density of the recorded image were measured with a Macbeth densitometer to evaluate the light resistance.

Water Resistance

After recording in the evaluation of recording density, the heat-sensitive recording material was immersed for 24 hours in water at 20° C., and then the heat-sensitive recording material was allowed to dry naturally. The optical density of the recorded image was measured with a Macbeth densitometer to evaluate the water resistance.

Hot Water Resistance

After recording in the evaluation of recording density, the heat-sensitive recording material was immersed for 30 seconds in hot water at 90° C., and then the heat-sensitive recording material was allowed to dry naturally. The optical density each of the unrecorded portion and the recorded image was measured with a Macbeth densitometer to evaluate the hot water resistance.

Plasticizer Resistance

A wrap film (trade name: Hiwrap KMA-W, made by Mitsui Chemical) was wound 3-fold around a polypropylene pipe (40 mm diameter). A heat-sensitive recording material having formed images thereon was superposed on the film with the images directed outward and thereon was further wound a wrap film three-fold. After standing at 40° C. for 24 hours, the optical density of the images was measured with the above Macbeth densitometer, whereby the recording material was assessed for plasticizer resistance.

TABLE 1

| | Heat-sensitive recording layer | | | | | Recording density | | Heat resistance | Light resistance | | Water resistance | Hot water resistance | | Plasticizer resistance |
|---|---|---|---|---|---|---|---|---|---|---|---|---|---|---|
| | Leuco dye (melting point ° C.) | Developer | pigment | Sensitizer | Undercoat layer Pigment | Unrecorded portion | Recorded portion | Unrecorded portion | Unrecorded portion | Recorded portion | Recorded portion | Unrecorded portion | Recorded portion | Recorded portion |
| Ex. 1 | LDK (206) | PF201 | Al(OH)3 | SA | EP | 0.06 | 1.37 | 0.07 | 0.12 | 1.34 | 1.32 | 0.09 | 1.28 | 1.31 |
| Ex. 2 | LDK (206) | PF201 | Silica | SA | EP | 0.06 | 1.30 | 0.07 | 0.12 | 1.27 | 1.27 | 0.10 | 1.26 | 1.27 |
| Ex. 3 | LDK (206) | PF201 | Kaolin | SA | EP | 0.06 | 1.29 | 0.07 | 0.12 | 1.25 | 1.24 | 0.09 | 1.22 | 1.25 |
| Ex. 4 | LDK (206) | PF201 | Talc | SA | EP | 0.06 | 1.30 | 0.07 | 0.12 | 1.28 | 1.26 | 0.10 | 1.24 | 1.26 |
| Ex. 5 | LDK (206) | PF201 | Al(OH)3 | SB | EP | 0.06 | 1.40 | 0.08 | 0.12 | 1.36 | 1.36 | 0.14 | 1.34 | 1.34 |
| Ex. 6 | ODII (182) | PF201 | Al(OH)3 | SA | EP | 0.06 | 1.41 | 0.11 | 0.12 | 1.36 | 1.36 | 0.13 | 1.31 | 1.36 |
| Comp. Ex. 1 | LDK (206) | PF201 | CaCO3 | SA | HP | 0.06 | 1.35 | 0.07 | 0.12 | 1.32 | 1.01 | 0.34 | 0.92 | 1.31 |
| Comp. Ex. 2 | LDKM (227) | PF201 | CaCO3 | SA | HP | 0.06 | 1.30 | 0.07 | 0.12 | 1.27 | 1.00 | 0.32 | 0.92 | 1.26 |
| Comp. Ex. 3 | PS175 (225) | PF201 | CaCO3 | SA | HP | 0.06 | 1.28 | 0.07 | 0.14 | 1.25 | 0.96 | 0.38 | 0.90 | 1.25 |
| Comp. Ex. 4 | ODI (192) | PF201 | CaCO3 | SA | HP | 0.06 | 1.35 | 0.07 | 0.13 | 1.32 | 1.00 | 0.35 | 0.91 | 1.31 |
| Comp. Ex. 5 | PSP (217) | PF201 | CaCO3 | SA | HP | 0.06 | 1.24 | 0.09 | 0.15 | 1.00 | 0.93 | 0.29 | 0.85 | 1.20 |
| Comp. Ex. 6 | LDK (206) | PF201 | CaCO3 | SC | HP | 0.06 | 1.36 | 0.07 | 0.12 | 1.31 | 1.02 | 0.33 | 0.93 | 1.29 |
| Comp. Ex. 7 | LDK (206) | PF201 | CaCO3 | SD | HP | 0.06 | 1.32 | 0.08 | 0.12 | 1.29 | 0.96 | 0.36 | 0.90 | 1.28 |
| Comp. Ex. 8 | LDK (206) | PF201 | CaCO3 | SE | HP | 0.06 | 1.30 | 0.07 | 0.11 | 1.29 | 1.01 | 0.35 | 0.91 | 1.26 |
| Comp. Ex. 9 | LDK (206) | PF201 | MgCO3 | SA | EP | 0.06 | 1.34 | 0.12 | 0.12 | 1.30 | 0.99 | 0.40 | 0.81 | 1.32 |
| Comp. Ex. 10 | LDK (206) | PF201 | None | SA | EP | 0.06 | 1.36 | 0.13 | 0.12 | 1.32 | 1.30 | 0.26 | 1.29 | 1.31 |
| Comp. Ex. 11 | LDK (206) | D-8 | Al(OH)3 | SA | EP | 0.06 | 1.37 | 0.20 | 0.12 | 1.34 | 1.26 | 0.20 | 1.01 | 0.87 |
| Comp. Ex. 12 | LDK (206) | TG-SH | CaCO3 | SA | HP | 0.06 | 1.36 | 0.26 | 0.16 | 1.25 | 1.01 | 0.38 | 0.91 | 1.28 |
| Comp. Ex. 13 | LDK (206) | 2,4'-BPS | CaCO3 | SA | HP | 0.06 | 1.26 | 0.15 | 0.14 | 1.20 | 0.92 | 0.31 | 0.86 | 1.21 |
| Comp. Ex. 14 | ODII (182) | PF201 | CaCO3 | SA | HP | 0.06 | 1.38 | 0.18 | 0.14 | 1.35 | 0.98 | 0.34 | 0.90 | 1.31 |
| Comp. Ex. 15 | S-205 (164) | PF201 | CaCO3 | SA | HP | 0.06 | 1.36 | 0.21 | 0.14 | 1.33 | 0.99 | 0.36 | 0.90 | 1.32 |
| Comp. Ex. 16 | Phthalide (217) | PF201 | CaCO3 | SA | HP | 0.06 | 1.29 | 0.26 | 0.15 | 1.23 | 0.93 | 0.35 | 0.84 | 1.21 |
| Comp. Ex. 17 | PSD-VI (235) | PF201 | CaCO3 | SA | HP | 0.06 | 1.18 | 0.10 | 0.18 | 1.12 | 0.81 | 0.29 | 0.78 | 1.11 |

The abbreviations in Table 1 stand for the meanings listed in Table 2 below.

TABLE 2

| Abbreviation | Meaning |
|---|---|
| LDK | 3-(N-ethyl-p-toluidino)-6-methyl-7-anilinofluoran (melting point: 206° C.) |
| ODII | 3-di(n-butyl)amino-6-methyl-7-anilinofluoran (melting point: 182° C.) |
| LDKM | 3-(N-ethyl-p-toluidino)-6-methyl-7-(p-toluidino)fluoran (melting point: 227° C.) |
| PS175 | 3-pyrrolidino-6-methyl-7-anilinofluoran (melting point: 225° C.) |
| ODI | 3-diethylamino-6-methyl-7-anilinofluoran (melting point: 192° C.) |

TABLE 2-continued

| Abbreviation | Meaning |
|---|---|
| PSP | 3-diethylamino-7,8-benzofluoran (melting point: 217° C.) |
| S-205 | 3-(N-ethyl-N-isoamylamino)-6-methyl-7-anilinofluoran (melting point: 164° C.) |
| Phthalide | 3-(4-diethylamino-2-methylphenyl)-3-(4-dimethylaminophenyl)-6-dimethylaminophthalide (melting point: 217° C.) |
| PSD-VI | 3-diethylamino-6-methyl-7-chlorofluoran (melting point: 235° C.) |
| PF201 | N-p-toluenesulfonyl-N'-3-(p-toluenesulfonyloxy)phenylurea |
| D-8 | 4-hydroxy-4'-isopropoxydiphenylsulfone |

TABLE 2-continued

| Abbreviation | Meaning |
|---|---|
| TG-SH | Bis(3-allyl-4-hydroxyphenyl)sulfone |
| 2,4'-BPS | 2,4'-dihydroxydiphenylsulfone |
| SA | 1,2-di(3-methylphenoxy)ethane |
| SB | 1,2-diphenoxyethane |
| SC | 2-naphthyl benzyl ether |
| SD | di(p-methylbenzyl) oxalate |
| SE | 2-(2'-hydroxy-5'-methylphenyl)benzotriazole |
| HP | hollow particles |
| EP | Expandable particles |

As shown in Table 1, the heat-sensitive recording materials of the present invention exhibit excellent recording sensitivity, heat resistance of the unrecorded portion, and stability of the recorded image.

What is claimed is:

1. A heat-sensitive recording material comprising a support and a heat-sensitive recording layer formed on the support and containing a leuco dye and a developer;

the developer is N-p-toluenesulfonyl-N'-3-(p-toluenesulfonyloxy)phenylurea, and the heat-sensitive recording layer contains (a) at least one fluoran-based leuco dye having a melting point of 190 to 230° C. or 3-di(n-butyl)amino-6-methyl-7-anilinofluoran, and (b) aluminum hydroxide as a pigment in an amount of 3 to 50 wt % based on the heat-sensitive recording layer.

2. The heat-sensitive recording material according to claim 1, wherein the fluoran-based leuco dye having a melting point of 190 to 230° C. is 3-(N-ethyl-p-toluidino)-6-methyl-7-anilinofluoran.

3. The heat-sensitive recording material according to claim 1, wherein the heat-sensitive recording layer further contains one or more sensitizers.

4. The heat-sensitive recording material according to claim 3, wherein the sensitizer is at least one member selected from the group consisting of 2-naphthyl benzyl ether, 1,2-di(3-methylphenoxy)ethane and 1,2-diphenoxyethane.

5. The heat-sensitive recording material according to claim 1, which further comprises, between the support and the heat-sensitive recording layer, an undercoat layer comprising as the main components a binder and at least one member selected from the group consisting of (i) an oil-absorbing pigment with an oil absorption (according to JIS K 5101) of at least 70 ml/100 g and (ii) organic hollow particles.

6. The heat-sensitive recording material according to claim 5, which further comprises, on the heat-sensitive recording layer, a protective layer comprising as the main components a binder which has a film-forming ability and, if desired, a pigment.

7. The heat-sensitive recording material according to claim 1, which further comprises, on the heat-sensitive recording layer, a protective layer comprising as the main components a binder which has a film-forming ability and, if desired, a pigment.

* * * * *